US006497211B2

(12) United States Patent
Nomura et al.

(10) Patent No.: US 6,497,211 B2
(45) Date of Patent: Dec. 24, 2002

(54) LUBRICATION STRUCTURE OF POWER UNIT

(75) Inventors: Akifumi Nomura, Saitama (JP); Tomio Onozato, Saitama (JP); Yasuo Shimura, Saitama (JP); Toshihiro Miki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/974,884

(22) Filed: Oct. 12, 2001

(65) Prior Publication Data

US 2002/0043237 A1 Apr. 18, 2002

(30) Foreign Application Priority Data

Oct. 13, 2000 (JP) ..... 2000-314344

(51) Int. Cl.[7] ..... F02F 7/00
(52) U.S. Cl. ..... 123/195 R; 123/196 R
(58) Field of Search ..... 123/196 R, 195 R

(56) References Cited

FOREIGN PATENT DOCUMENTS

JP A6-288214 10/1994

*Primary Examiner*—Noah P. Kamen
(74) *Attorney, Agent, or Firm*—Birch, Stewart, Kolasch & Birch, LLP

(57) ABSTRACT

A power unit has a power case which includes a crankcase portion integrally formed with a transmission case portion. The crankcase portion forms a crankcase in which the crankshaft of a 4-cycle internal combustion engine is received. The transmission case portion forms a transmission case in which a wet type multiple disc friction clutch for transmitting the torque of the crankshaft is received. A partition wall makes the crankcase independent of the transmission case, and thus separates the lubrication system of the internal combustion engine from the lubrication system of the friction clutch. The lubrication structure of the present invention can improve the durability of the friction clutch and make the friction clutch compact, and secure good connection performance of the friction clutch by separating the lubrication system of an internal combustion engine from the lubrication system of friction clutch.

20 Claims, 3 Drawing Sheets

LUBRICATION STRUCTURE OF POWER UNIT

This nonprovisional application claims priority under 35 U.S.C. §119(a) on Patent Application No. 2000-314344 filed in Japan on Oct. 13, 2000, which is herein incorporated by reference.

BACKGROUND OF THE INVENTION

1. Field of the Invention

The present invention relates to the lubrication structure of a power unit mounted on, for example, a vehicle. The power unit has a power case in which a crankcase is integrally formed with a transmission case. A crankshaft of a 4-cycle internal combustion engine is received in the crankcase. A wet type friction clutch is received in the transmission case.

2. Description of the Background Art

A conventional lubrication structure of this kind of power unit, for example, is shown in the lubrication structure disclosed in Japanese Patent Unexamined Publication No. 6-288214. In the conventional structure, a clutch case having a multiple disc friction clutch therein communicates with a transmission case having an output shaft and a transmission shaft therein which is provided with various kinds of gears. The communication is via a communication hole and an oil pan to keep the oil level in the transmission case and that of the clutch case at the nearly same level. Also, a magnet case in which a flywheel magnet is received communicates with a crankshaft case in which a crankshaft is received via the communication hole to keep the oil level in the crankshaft case and the oil level in the magnet case at the nearly same level.

The oil stored at the bottom portion of the crankshaft case is sucked, pressurized and discharged into the transmission case by a suction oil mechanism. The oil sucked from a suction port made in the transmission case is pressurized by the oil pump mechanism for lubrication, is cleaned by a oil filter, then is sent to the crankshaft, crankpin and lubricating portions in the crankcase, and then is returned to the crankcase after lubrication.

In the conventional lubrication structure, the oil stored in the transmission case, the clutch case and the oil pan is used for lubricating the lubricating portions in the crankshaft and the crankcase of the internal combustion engine, and is sucked by the suction oil pump mechanism and is returned to the transmission case. Thus, the lubrication system of the internal combustion engine and the lubrication system of the transmission shaft and the multiple disc friction clutch have a shared portion and use the same lubricating oil. Therefore, the oil lubricating the internal combustion engine is used for the lubrication system of the transmission shaft and the clutch.

However, the oil lubricating the internal combustion engine receives combustion heat and increases in temperature, and its viscosity is decreased by the increased oil temperature. Accordingly, this reduces the cooling capacity of the oil for cooling the multiple disc clutch, and thus reducing the durability of the multiple disc clutch. Therefore, in order to secure a clutch capacity, that is, a friction force necessary for good clutch connection, it is necessary to enlarge the diameter of a friction disc or to increase the number of the friction discs, which presents a problem of enlarging the clutch and thus the power unit.

Further, in the case where an additive is added to the lubricating oil in order to reduce the friction of the sliding portions of the crankshaft and a piston, the same lubricating oil is also used for the multiple disc friction clutch, and hence it produces a slip on the multiple disc friction clutch, resulting in a reduction of the connection performance thereof.

SUMMARY OF THE INVENTION

It is therefore an object of the present invention to provide a lubrication structure of a power unit which can improve the durability of the friction clutch and make the friction clutch compact and secure good connection performance of the friction clutch by separating the lubrication system of a 4-cycle internal combustion engine from the lubrication system of a wet type friction clutch.

The present invention is a lubrication structure of a power unit having a power case in which a crankcase portion for forming a crankcase, in which the crankshaft of a 4-cycle internal combustion engine is received, is integrally formed with a transmission case portion for forming a transmission case, in which a wet type friction clutch for transmitting the torque of the crankshaft is received. The crankcase and the transmission case are formed in independent cases, and the lubrication system of the internal combustion engine is separated from the lubrication system of the friction clutch.

The crankcase is made independent of the transmission case, and the flow of the lubricating oil is stopped between both cases in the integrally formed power case. In this way, the lubrication system of the internal combustion engine is separated from the lubrication system of the friction clutch. Accordingly, the lubricating oil for the internal combustion engine for lubricating the lubricating portions of the internal combustion engine, such as lubricating portions in the crankcase and others, is not mixed with the lubricating oil for the transmission mechanism supplied for the wet type friction clutch. Accordingly, since the friction clutch is not supplied with the lubricating oil for the internal combustion engine whose temperature is raised to a comparatively high temperature by the combustion heat, or which includes an additive for reducing the friction, the friction clutch is effectively cooled by the lubricating oil for the transmission mechanism, which is not heated by the combustion heat and has a comparatively low temperature, and is prevented from slipping owing to the lubricating oil for the internal combustion engine, whose viscosity is reduced by the high temperatures or which includes the additive described above, to secure a large friction force.

As a result, the following effects are made. Since the friction clutch is not supplied with the lubricating oil for the internal combustion engine whose temperature is raised to a comparatively high temperature by the combustion heat, the cooling ability of the lubricating oil is improved, and hence the durability of the friction clutch is also improved. Also, since the friction clutch is not supplied with the lubricating oil for the internal combustion engine whose temperature is raised to a high temperature to reduce its viscosity or which contains the additive for reducing the friction, it is possible to easily secure a necessary friction force and hence to realize a set clutch capacity by a compact friction clutch, and further to prevent the friction clutch from slipping and hence to obtain the friction clutch having a good connection performance. In this manner, since the friction clutch can be made compact, the power unit can also be made compact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
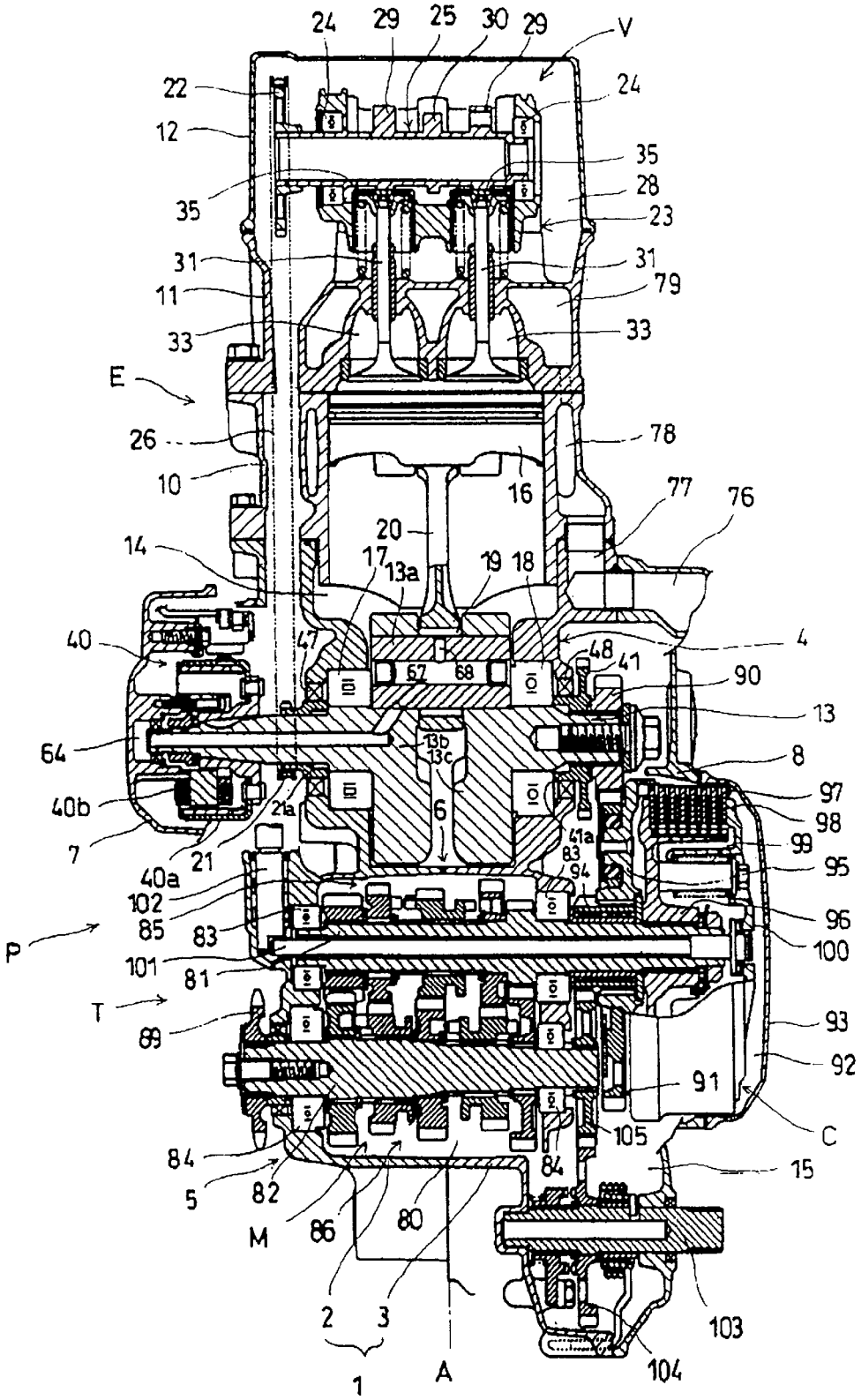
FIG. 1 is a cross-sectional view, taken along a line I—I in FIG. 2, of a power unit having a 4-cycle internal combustion engine and a friction clutch to which the present invention is applied.
Figure 2:
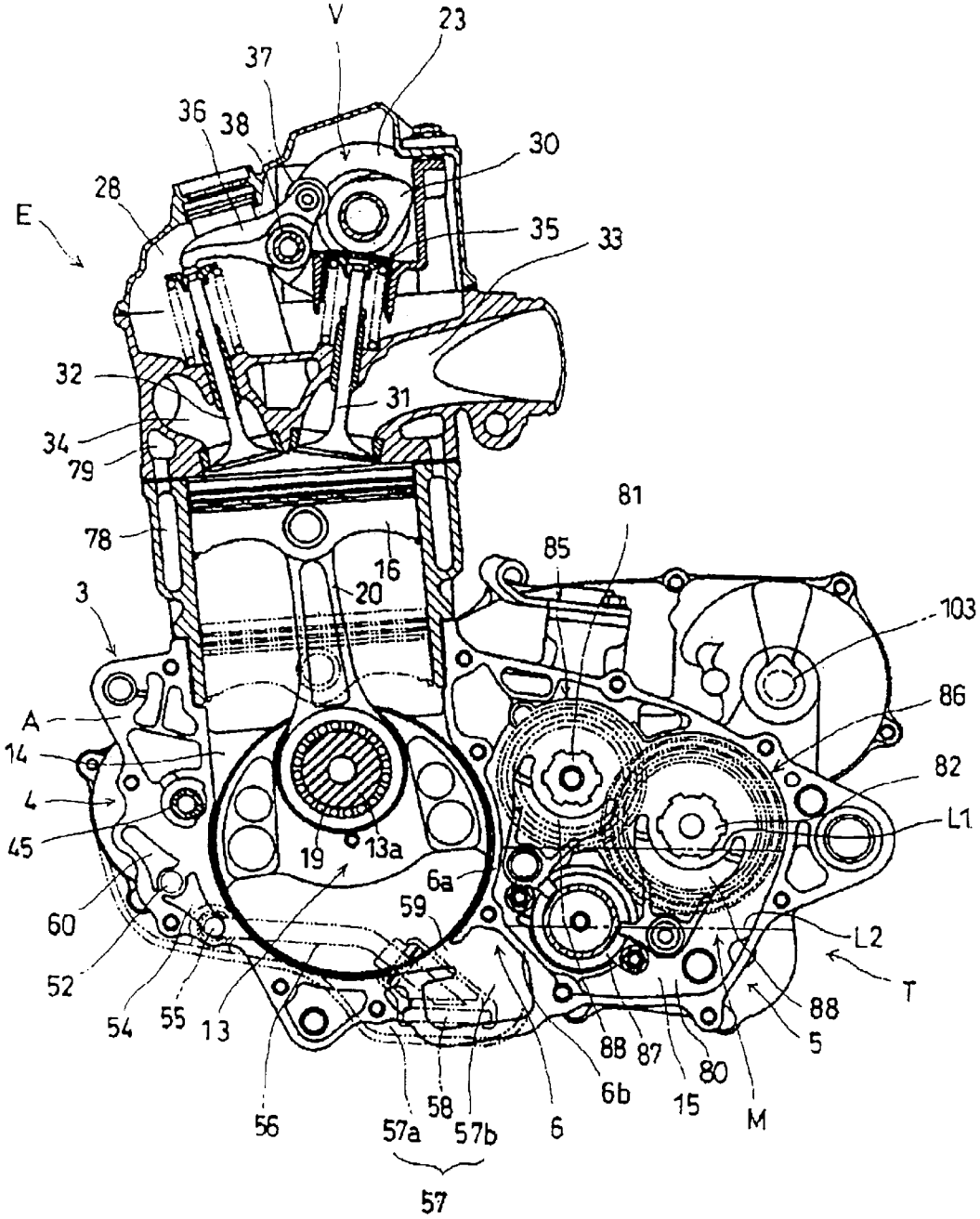
FIG. 2 is a view, when viewed from the mating surface (from the left side), of a right case constituting the power case.
Figure 3:
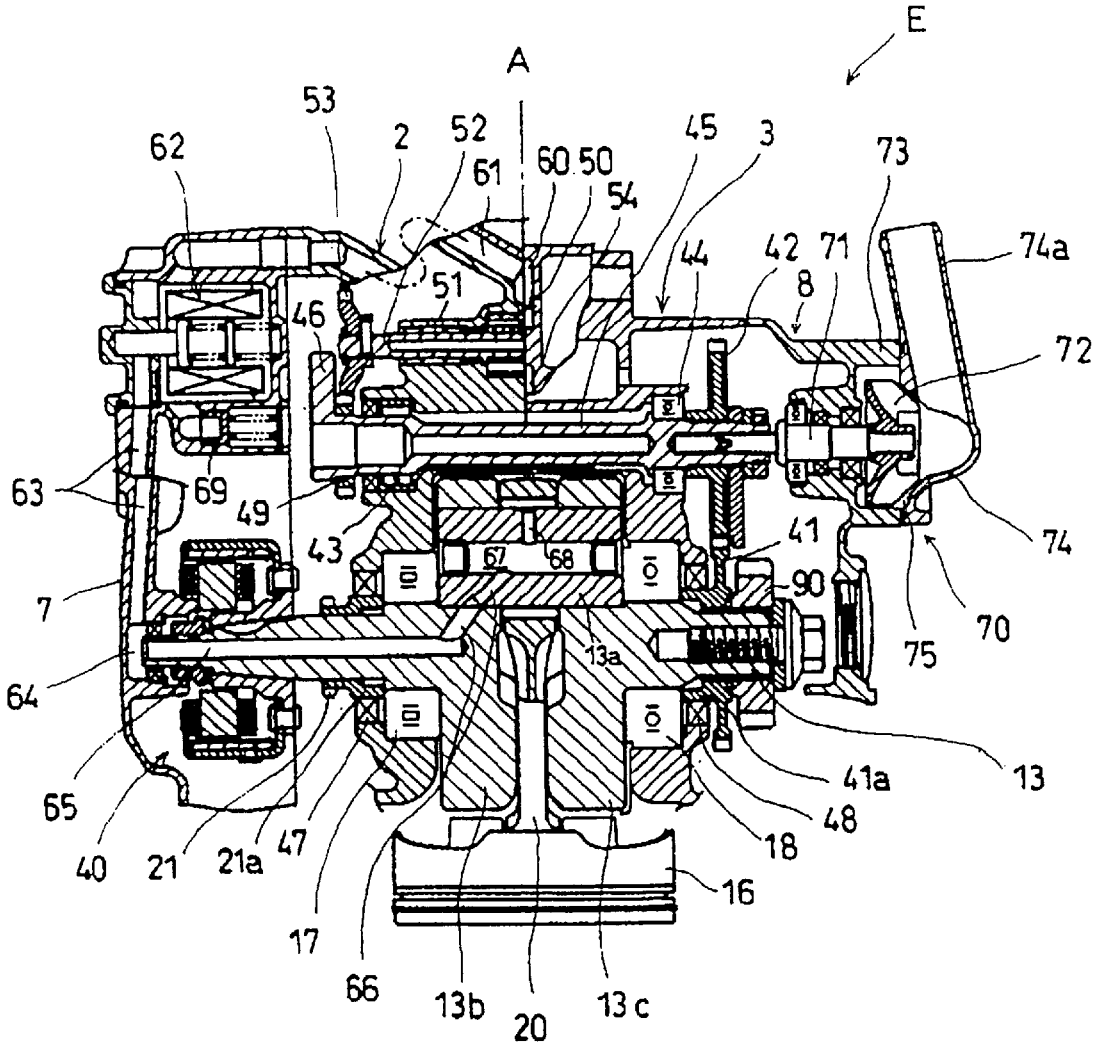
FIG. 3 is a cross-sectional view taken on a plane including the rotational axis of the crankshaft and the rotational axis of the balancer axis.

One preferred embodiment of the present invention will be described with reference to FIG. 1 to FIG. 3. Referring now to FIG. 1 and FIG. 2, a power unit P, to which the present invention is applied and which is mounted on a motorcycle, has a spark ignition type 4-cycle internal combustion engine E and a transmission mechanism T which is provided with a wet type multiple disc friction clutch C and a constantly engaged gear transmission M. In a water-cooled SOHC type single cylinder internal combustion engine E, a cylinder 10 having a center line slightly slanting forward, a cylinder head 11, and a head cover 12 are sequentially overlaid on a crankcase portion 4, which is a part of a power case 1, and are fastened by bolts. In this connection, in this preferred embodiment, words of "front and rear" or "left and right" mean that the "front and rear" or the "left and right" are with respect to a vehicle body.

The power case 1 includes a crankcase portion 4 for forming a closed crankcase 14, in which the crankshaft 13 of the internal combustion engine E is received, which is integrally formed with a transmission case portion 5 for forming a part of a transmission case 15, in which the friction clutch C and the gear transmission M of the transmission mechanism T are received. The power case 1 is composed of a left case 2 and a right case 3 which are divided into two parts by a mating surface A which is a plane including the center line of the cylinder 10 and crossing at right angles to the rotational axis of the crankshaft 13.

A left cover 7 is fastened to the open portion on the left side of the left case 2 by bolts to form a chain case 27 described later. A right cover 8 is fastened to the open portion on the right side of the right case 3 by bolts to form the remaining portion of the transmission case 15. The crankcase 14 and the transmission case 15 are separated from each other by a partition wall 6 integrally formed with the power case 1 to interrupt the flow of the lubricating oil between the crankcase 14 and the transmission case 15.

A piston 16 is slidably fitted in the cylinder 10. The piston 16 is connected to the crankpin 13*a* of the crankshaft 13 via a connecting rod 20 supported by a needle bearing 19. The crankshaft 13 is rotatably supported by the crankcase portion 4 by means of a pair of main bearings constituted by a roller bearing 17 fixed to the left case 2 and a ball bearing 18 fixed to the right case 3. Thus, the reciprocating piston 16 rotates the crankshaft 13.

A timing sprocket 21 is pressed on and fixed to the crankshaft 13 at the left portion of the roller bearing 17 outside the crankcase 14. A cam sprocket 22 is pressed on and fixed to the left end portion of a cam shaft 25 rotatably supported by a cam holder 23 fixed to the cylinder head 11 by bolts by means of a pair of ball bearings 24. A timing chain 26 is looped around the timing sprocket 2 ad the cam sprocket 22. Thus, the cam shaft 25 is rotated by the timing chain 26 at a speed reducing ratio of ½ of the crankshaft 13. The timing sprocket 21 and the timing chain 26 are positioned in a chain case 27 formed by the left case 2 and left cover 7. The timing chain 26 is passed through a chain passing hole made in the cylinder 10 and the cylinder head 11 and is positioned in a valve train case 28 formed by the cylinder head 11 and the head cover 12.

An exhaust cam 30 is provided on the cam shaft 25 received in the valve train case 28. A pair of inlet cams 29 are provided on the cam shaft 25 on both sides of the exhaust cam 30. A pair of inlet valves 31 provided on the cylinder head 11 are driven by the pair of inlet cams 29 via lifters 35 sliding on the inlet cams 29 to open or close a pair of inlet ports 33. Further, each of a pair of exhaust valves 32 provided on the cylinder head 11 has a base part provided with a roller 37 sliding on an exhaust cam 30 and is put into contact with and driven by each of a pair of tip portions of a bifurcated rocker arm 36 supported by a rocker shaft 38 fixed to the cam holder 23 such that it oscillates freely, to thereby open or close a pair of exhaust ports 34. Therefore, the cam shaft 25, the inlet cams 29, the exhaust cams 30, the rocker shaft 38 and the rocker arm 36 constitute a valve train V received in the valve train case 28.

An alternator 40 is provided on the left end portion of the crankshaft 13. The rotor 40*a* of the alternator 40 is coupled with a key to the crankshaft 13 and is integrally rotated with the crankshaft 13. The left side of the alternator 40 is covered with the left cover 7 to which the stator 40*b* of the alternator 40 is fixed.

A balancer drive gear 41 is coupled with a spline to the crankshaft 13 at the right part of the ball bearing 18 outside the crankcase 14. As shown in FIG. 3, the balancer drive gear 41 is engaged with a balancer gear 42 coupled with a spline to the right end portion of a balancer shaft 45 rotatably supported by the crankcase portion 4 by means of a roller bearing 43 fixed to the left case 2 and a ball bearing 44 fixed to the right case 3.The balancer shaft 45 having a balance weight 46 at the left end portion is rotated in the reverse direction at the same speed as the crankshaft 13 to prevent the occurrence of the primary vibration caused by an inertia force produced by the reciprocating motion of the piston 16.

An oil seal 47 is interposed adjacent to the left side of a roller bearing 17 for supporting the crankshaft 13 between a cylindrical part 21*a* integral with the timing sprocket 21 and the left case 2. An oil seal 48 is interposed adjacent to the right side of the ball bearing 18 between a cylindrical part 41*a* integral with the balancer drive gear 41 and the right case 3 to keep the oil hermetically sealed between the crankcase 14 and the transmission case 15.

Describing the lubrication system of the internal combustion engine E, a drive gear 49 for driving an oil pump 50 is pressed in the left end portion of the balancer shaft 45 and is engaged with a pump gear 53 coupled with a key to a pump shaft 52 supported by the left case 2 of the crankcase portion 4 via a roller bearing 51. A trochoid type oil pump 50 has an outer rotor rotatably received in a rotor receiving case having a recessed portion open to the mating surface A of the left case 2, and an inner rotor inscribed in the outer rotor and fixed to the right end portion of the pump shaft 52 such that it is rotated integrally with the pump shaft 52.

Referring also to FIG. 2, an inlet port 54 made in the mating surface A of the right case 3 communicates with an oil pan 57 having a recessed portion formed under the crankcase portion 4 via an inner oil passage 55 in the left case 2 of the crankcase portion 4 and an inlet oil pipe 56. This oil pan 57 has a right case 57*b,* which is formed by a right slant portion 6*b* slanting from the vicinity of the tip end portion of a right curved portion 6*a* extending along the outer periphery of a right crank web 13*c* of the right case 3 of a partition wall 6 and the bottom portion of the right case 3 of the crankcase portion 4, and a left case 57*a,* which communicates with the right case 57*b* at the mating surface A and is formed by a left slant portion of the left case 2 formed in the same way as the right slant portion 6*a* of the right case 3 and the bottom portion of the left case 2 of the crankcase portion 4 and the left cover 7.

In the left case 57*a* is received a strainer 58 connected to the inlet pipe 56 passing through the chain case 27. Further, of the right case 57*b* and the left case 57*a,* in a portion formed by the left slant portion and the bottom portion of the left case 2 of the crankcase portion 4 is made the discharge port 59 of the lubricating oil which is open to the crankcase 14.

A discharge port 60 made in the mating surface A of the right case 3 communicates with an inner oil passage 61 in the left case 2 of the crankcase portion 4 and an oil filter 62 mounted on the left cover 7. The outlet port of the oil filter 62 communicates with an oil case 64 opposed to the left end surface of the crankshaft 13 and communicates also with a head oil passage (not shown) made in the cylinder 10 and communicating with the valve train case 28 of the cylinder head 11. An oil passage 65, which is made in the axial direction in the crankshaft 13 and which is open to the oil case 64 at the left end portion, communicates with an oil case 67 in the crankpin 13*a* via an oil passage 66 extending in the radial direction in a left crank web 13*b* and the crankpin 13*a,* and the oil case 67 communicates with an oil passage 68 which is open to the connection portion of the large end portion of the connecting rod 20, whereas the head oil passage communicates with an inner oil passage (not shown) in the cam holder 23 disposed in the valve train case 28. Then, in the cylinder 10 is made a return oil passage (not shown) for flowing the lubricating oil having lubricated the valve train V down into the crankcase 14.

In this connection, a reference numeral 69 designates a relief valve, which is fixed to the left cover 7 and regulates the upper limit of the discharge pressure of the lubricating oil discharged from the oil pump 50. Further, a drain port (not shown) communicating with the oil pan 57 is formed by a screw hole into which a bolt for fastening the left case 2 to the left cover 7 is screwed.

The pump shaft 71 of a cooling water pump 70 is integrally concentrically coupled on the right end portion of the balancer shaft 45, and an impeller 72 fixed to the tip end portion of the pump shaft 71 is disposed in a pump case 75 formed by a pump body 73 formed in the right cover 8 and a pump cover 74 fastened to the right cover 8 by bolts. Then, the cooling water of a radiator flowing from a flow-in passage 74*a* of the pump cover 74 into the pump case 75 is pressurized by the impeller 72 rotated by the pump shaft 52 and, as shown in FIG. 1, is sent from the flow-out passage 76 formed in the right cover 8 through a water passage 77 formed in the crankcase portion 4 to the cooling water jacket 78 of the cylinder 10 and to the cooling water jacket 79 of the cylinder head 11 to cool the cylinder 10 and the cylinder head 11.

Next, describing the transmission mechanism T received in the transmission case 15 with reference to FIG. 1 and FIG. 2, the gear transmission M disposed in the back of the crankshaft 13 constitutes a part of the transmission case 15 and is received in a transmission case 80 formed by the left case 2, the right case 3 and the partition wall 6. The main shaft 81 and the counter shaft 82 of the gear transmission M are rotatably supported in parallel to the rotational axis of the crankshaft 13 by the left case 2 and the right case 3 of the transmission case portion 5 via a pair of ball bearings 83 and a pair of ball bearings 84.

The main shaft 81 and the counter shaft 82 of the gear transmission M are provided with a group of main gears 85 and a group of counter gears 86, respectively. When a shift drum 87 is rotated by a shift operation mechanism (not shown), a shift fork 88 engaged with the cam groove of the shift drum 87 is appropriately moved in the left and right direction to appropriately engage the gear of the group of main gears 85 responsive to the shift operation with the gear of the group of counter gears 86, whereby the torque of the crankshaft 13 is shifted and transmitted from the main shaft 81 to the counter shaft 82. Then, the torque of the counter shaft 82 is transmitted to a rear wheel via a secondary speed reducing mechanism made of a drive sprocket 89 coupled with a spline to the left end portion of the counter shaft 82, a transmission chain (not shown), and a driven sprocket fixed to the rear wheel shaft.

Further, on the right end portion of the main shaft 81 is mounted a friction clutch C, and a primary drive gear 90 coupled with a spline to the right end portion of the crankshaft 13 on the right side of a balancer drive gear 41 is engaged with a primary driven gear 91 integrally coupled to the clutch outer 95 of the friction clutch C via an elastic body to constitute a primary speed reducing mechanism. This friction clutch C is received in a clutch case 92 constituting a part of the transmission case 15, and the clutch case 92 is formed of the right cover 8, a clutch cover 93 fixed to the right cover 8, and a partition wall (not shown) which is a part of the right case 3 and partitions off the transmission case 80 and the clutch case 92.

The friction clutch C is provided with many friction discs 97 engaged with the clutch outer 95 coupled with a spline to the cylindrical portion of a driven gear 94 rotatably supported by the main shaft 81, many clutch discs 98 engaged with the clutch inner 96 coupled with a spline to the main shaft 81, wherein the friction discs 97 and the clutch discs 98 are alternately laminated to each other, and further a pressure plate 100 for pressing both the discs 97, 98 by the resilient force of a clutch spring 99 to generate a friction force to put the friction clutch C into a connection state. The position in the axial direction of the pressure plate 100 is controlled by a push rod 101 received in the hollow portion of the main shaft 81 such that it can freely move in the axial direction of the main shaft 81. This push rod 101 is pressed and moved to the right by the cam of a cam shaft 102 turned by a clutch lever to release the force of the pressure plate 100 for pressing both the discs 97, 98 by the resilient force of the clutch spring 99, whereby the friction clutch C is put into a disengaged state.

Further, an idle gear 105 engaged with a pinion gear 104 coupled to a kick starter shaft 103 of a kick starter is rotatably supported by the right end portion of the counter shaft 82 and is engaged with the driven gear 94 rotatably supported by the main shaft 81. Therefore, when the engine is started, the rotation of a pinion gear 104 produced by the operation of a kick pedal is transmitted to a primary drive gear 90 via the idle gear 105, the driven gear 94, the clutch outer 95 and a primary driven gear 91 to rotate the crankshaft 13.

Describing now the lubrication system of the transmission mechanism T, a lubricating oil for the transmission mechanism of the kind different from a lubricating oil for the internal combustion engine used for the lubrication system of the internal combustion engine E is put into the transmission case 15 from a supply port (not shown) other than a supply port (not shown) of the lubricating oil to the oil pan 57 to form an oil level L1 (see FIG. 2) at which a portion of each of gears constituting the group of main gears 85 and the group of counter gears 86 of the gear transmission M is dipped in the oil in the transmission case 80. Then, the rotating gears stir up the lubricating oil and the stirred-up lubricating oil lubricates the engaged portions and the sliding portions of the gear transmission M.

Further, the lubricating oil for the transmission mechanism is put into the clutch case 92 from the supply port described above to form an oil level L2 (see FIG. 2) at which portions of the friction discs 97 and the clutch discs 98 are dipped in the oil in the clutch case 92 to cool the friction clutch C and lubricate the sliding portions of the friction clutch C. Here, the oil level L2 in the clutch case 92 is set at a level lower than the oil level L1 in the transmission case 80.

Still further, the partition wall described above has two inlets each communicating with the transmission case 80 and the clutch case 92, respectively, and a drain port (not shown) having a single outlet. When the lubricating oil is put in, a drain bolt is screwed into the outlet of the drain port to store the lubricating oil in the transmission case 80 and the clutch case 92 at the different oil levels in the state where the two inlets do not communicate with each other. When the oil is drained, the drain bolt is removed to discharge the lubricating oil in the transmission case 80 and in the clutch case 92.

In this connection, a check unit of the amount of lubricating oil and a breather are also provided separately in the lubrication system of the internal combustion engine E and in the lubrication system of the transmission mechanism T.

Next, the operation and the effects of the preferred embodiment constituted in the above manner will be described. Describing the lubrication of the power unit P, first, in the internal combustion engine E, when the internal combustion engine E is operated and the oil pump 50 is driven, the lubricating oil for internal combustion engine, which is sucked by the oil pump 50 from the oil pan 57 through a strainer 58, the inlet oil pipe 56, the inner oil passage 55, and the inlet port 54, is pressurized by the oil pump 50 and is discharged from the discharge port 60 and is flown through the oil filter 62 via the inner oil passage. 61, whereby the foreign substances in the lubricating oil are removed. The cleaned lubricating oil flows from the oil filter 62 to the oil case 64 via the inner oil passage 63 and then flows into the crankshaft 13, the axial oil passage 65, the oil passage 66, the oil case 67, and the oil passage 68 and lubricates the needle bearing 19 at the connection portion of the crankpin 13*a* and the large end portion of the connecting rod 20 and then is sprayed in the crankcase 14 to lubricate the sliding portions between the piston 16 and the cylinder 10 and the lubricating portions in the crankcase 14, such as the roller bearing 17 and the ball bearing 18.

On the other hand, of the cleaned lubricating oil, the lubricating oil flowing into the head oil passage passes through the inner oil passage in the cam holder 23 and lubricates lubricating portions in the valve train case 28 such as the sliding portions of the cam shaft 25 and the rocker arm 36, and part of the lubricating oil further lubricates the lubricating portions in the chain case 27 such as the engaging portions of the timing chain 26, the timing sprockets 21, the drive gear 49, and the pump gear 53. Then, the lubricating oil having lubricated the lubricating portions in the crankcase 14 is returned to the oil pan 57 via the discharge port 59, and the lubricating oil having lubricated the lubricating portions in the valve train case 28 is flown down to the crankcase 14 through a return oil passage and then is returned to the oil pan 57 through the discharge port 59. In this connection, the lubricating oil having lubricated the lubricating portions in the chain case 27 is returned to the oil pan 57 from the opening of the left case of the oil pan 57.

On the other hand, in the transmission mechanism T, the lubricating oil for the transmission mechanism of a kind different from the lubricating oil for the internal combustion engine is put into the transmission case 80 and into the clutch case 92 to form the above-mentioned oil levels L1, L2 set in the cases 80, 92. In the transmission case 80, the respective rotating gears stir up the lubricating oil and the stirred-up lubricating oil lubricates the engaging portions and the sliding portions of the gears of the gear transmission M and the lubricating portions of the ball bearings, and in the clutch case 92, the lubricating oil cools the friction clutch C and lubricates the lubricating portions such as the sliding portions of the friction clutch C. Further, the lubricating oil stored in the clutch case 92 is stirred up by the primary driven gear 91 to lubricate the lubricating portions in the transmission case 15 such as the engaging portions of the primary drive gear 90, the balancer drive gear 41, and the balancer gear 42.

In this manner, the crankcase 14 is made independent of the transmission case 15 including the transmission case 80 and the clutch case 92 and the flow of the lubricating oil is stopped between the crankcase 14 and the transmission case 80 and the clutch case 92 in the integrally formed power case 1, whereby the lubrication system of the internal combustion engine E is separated from the lubrication system of the friction clutch C and the gear transmission M, which constitute the transmission mechanism T. Accordingly, the lubricating oil for the internal combustion engine for lubricating the lubricating portions of the internal combustion engine E such as lubricating portions in the crankcase 14, the lubricating portions in the valve train case 28, and the lubricating portions in the chain case 27 is not mixed with the lubricating oil for the transmission mechanism supplied for lubricating the lubricating portions of the gear transmission M and for cooling the wet type friction clutch C and for lubricating the lubricating portions thereof.

As a result, the lubricating oil for the internal combustion engine, whose temperature is raised to a comparatively high temperature by the combustion heat received while it passes through the high temperature portions of the cylinder 10 and the cylinder head 11, or which includes an additive for reducing the friction, is not supplied to the gear transmission M and the friction clutch C. Therefore, the friction clutch C is effectively cooled by the lubricating oil for the transmission mechanism, which is not heated by the combustion heat and has a comparatively low temperature, and is prevented from slipping owing to the lubricating oil for the internal combustion engine, whose viscosity is reduced by the high temperatures and which includes the additive described above, to thereby secure a large friction force.

As a result, the following effects are made. That is, the lubricating system of the internal combustion engine is separated from the lubricating system of the transmission mechanism T. Accordingly, since the friction clutch C is not supplied with the lubricating oil for the internal combustion engine whose temperature is raised to a comparatively high temperature by the combustion heat, the cooling ability of the lubricating oil is improved and hence the durability of the friction clutch is also improved. Further, since the friction clutch C is not supplied with the lubricating oil for the internal combustion engine whose temperature is raised to a high temperature to reduce its viscosity or which contains the additive for reducing the friction, it is possible to easily secure a necessary friction force and hence to realize a set clutch capacity by a compact friction clutch C, and further to prevent the friction clutch C from slipping and hence to obtain the friction clutch C having a good connection performance. In this manner, since the friction clutch C scan be made compact, the power unit P can also be made compact.

Since the drain port communicating with the oil pan 57 is formed by the screw hole into which the bolt for fastening the left case 2 to the left cover 7 is screwed, it is possible to reduce the number of parts and further to make an effect of reducing the weight of the power unit P. Further, since the transmission case 80 shares the above-mentioned drain port with the clutch case 92, it is possible to simplify a drain structure and to produce an effect of facilitating a maintenance including a lubricating oil replacement.

Since the constituent parts of the lubrication system of the internal combustion engine E such as the strainer 58, the inlet oil pipe 56, the oil pump 50, the oil filter 62, the chain case 27 which is also the return passage of the lubricating oil from the valve train case 28 are concentrated on the left case 2 and the left cover 7, it is possible to simplify the oil passages and to make an effect of facilitating the maintenance of the lubrication system.

Further, in the oil pump 50, a pump body for forming a rotor receiving case is formed by the left case 2 and a pump cover thereof is formed by the right case 3 and thus a pump body and a pump cover dedicated for forming the oil pump 50 is not necessary. As a result, since the pump body and the pump cover of the oil pump 50 are formed by the left case 2 and the right case 3 by the use of the mating surface A, it is possible to reduce the number of parts and to make an effect of reducing costs.

In a preferred embodiment in which a portion of constitution of the above-mentioned preferred embodiment is modified, a modified constitution will be described in the following. In the oil pan 57 of the above-mentioned preferred embodiment, a partition wall can be disposed between the strainer 58 which is the inlet portion of the lubricating oil and the discharge port 59 and can prevent the air inclusion which develops when bubbles produced when the lubricating oil finishing lubrication is flown into the oil pan 57 from the crankcase 14 are sucked with the lubricating oil from the strainer 58 by the oil pump 50. Further, in the above preferred embodiment, the lubrication system for the internal combustion engine E is a wet sump type having the oil pan 57 but may be a dry sump type.

In the above preferred embodiment, the friction clutch is a multiple disc friction clutch C but may be a friction clutch of a single plate type or the other types. Further, while the transmission is a gear transmission M of the constantly engaged type, it may be a gear transmission of another type. Still further, while the internal combustion engine E has been described as having a single cylinder, it may instead have multiple cylinders. Still further, the vehicle may be one other than a motorcycle, for example, a three-wheeled vehicles or a small-size 4-wheel vehicle.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lubrication structure of a power unit having a power case in which a crankcase portion for forming a crankcase, in which the crankshaft of a 4-cycle internal combustion engine is received, is integrally formed with a transmission case portion for forming a transmission case, in which a wet type friction clutch for transmitting the torque of the crankshaft is received, wherein the crankcase and the transmission case are formed in independent cases and wherein the lubrication system of the internal combustion engine is separated from the lubrication system of the friction clutch.

2. A power unit, comprising:

a power case including a crankcase portion integrally formed with a transmission case portion;

a partition wall located within said power case for dividing said power case into said crankcase portion and said transmission case portion;

said crankcase portion forming a crankcase of an internal combustion engine in which a crankshaft is received, said crankcase including a first lubrication system;

said transmission case portion forming a transmission case in which a friction clutch for transmitting the torque of the crankshaft is received, said transmission case including a second lubrication system, wherein said first lubrication system is separate and isolated from said second lubrication system.

3. The power unit as set forth in claim 2, further comprising a plurality of transmission gears located within said transmission case.

4. The power unit as set forth in claim 3, wherein said transmission gears comprise a plurality of main gears, and a plurality of counter gears engaged with said main gears.

5. The power unit as set forth in claim 4, wherein said second lubrication system includes a first section of said transmission case with a first level of lubricant, and a second section of said transmission case with a second level of lubricant.

6. The power unit as set forth in claim 5, wherein said first level is lower than said second level.

7. The power unit as set forth in claim 5, wherein said friction clutch is located in said first section of said transmission case.

8. The power unit as set forth in claim 5, wherein said transmission gears are located in said second section of said transmission case.

9. The power unit as set forth in claim 8, wherein said friction clutch is located in said first section of said transmission case.

10. The power unit as set forth in claim 9, wherein said first level is lower than said second level.

11. The power unit as set forth in claim 2, wherein said second lubrication system includes a first section of said transmission case with a first level of lubricant, and a second section of said transmission case with a second level of lubricant.

12. The power unit as set forth in claim 11, wherein said first level is lower than said second level.

13. The power unit as set forth in claim 11, wherein said friction clutch is located in said first section of said transmission case.

14. The power unit as set forth in claim 13, wherein said first level is lower than said second level.

15. A power unit, comprising:

an internal combustion engine including a crankcase;

a crankshaft rotatably mounted in said crankcase;

a cylinder having a piston slidably mounted therein; and a connecting rod interconnecting said crankshaft with said piston;

a transmission including a transmission case;

a main shaft rotatably mounted in said transmission case;

a plurality of main gears supported by said main shaft;

a friction clutch supported by said main shaft;

a countershaft rotatably mounted in said transmission case; and a plurality of counter gears engaged with said main gears; and a power case, said crankcase and said transmission case being integrally formed by said power case, said power case including a partition wall therein for dividing said power case into said crankcase and said transmission case.

16. The power unit as set forth in claim 15, wherein said crankcase includes a first lubrication system, said transmission case includes a second lubrication system, and said first lubrication system is separate and isolated from said second lubrication system.

17. The power unit as set forth in claim 16, wherein said second lubrication system includes a first section of said transmission case with a first level of lubricant, and a second section of said transmission case with a second level of lubricant.

18. The power unit as set forth in claim 17, wherein said friction clutch is located in said first section of said transmission case.

19. The power unit as set forth in claim 18, wherein said main gears and said counter gears are located in said second section of said transmission case.

20. The power unit as set forth in claim 19, wherein said first level of lubricant is lower than said second level of lubricant.

* * * * *